US007174930B2

(12) United States Patent
Poldervaart et al.

(10) Patent No.: US 7,174,930 B2
(45) Date of Patent: Feb. 13, 2007

(54) CONNECTOR FOR ARTICULATED HYDROCARBON FLUID TRANSFER ARM

(75) Inventors: Leendert Poldervaart, La Turbie (FR); Jack Pollack, Monaco (MC); Jean-Pierre Queau, Nice (FR); Rene Perratone, Menton (FR)

(73) Assignee: Single Buoy Moorings Inc., Marly (CH)

( * ) Notice: Subject to any disclaimer, the term of this patent is extended or adjusted under 35 U.S.C. 154(b) by 419 days.

(21) Appl. No.: 10/486,163

(22) PCT Filed: May 31, 2002

(86) PCT No.: PCT/EP02/06032

§ 371 (c)(1),
(2), (4) Date: Feb. 6, 2004

(87) PCT Pub. No.: WO03/013951

PCT Pub. Date: Feb. 20, 2003

(65) Prior Publication Data

US 2004/0237869 A1 Dec. 2, 2004

(30) Foreign Application Priority Data

Aug. 6, 2001 (EP) ..... 01202973

(51) Int. Cl.
*B65B 1/04* (2006.01)

(52) U.S. Cl. ..... 141/387; 114/230.15; 441/5

(58) Field of Classification Search ..... 141/279, 141/387, 388; 114/230.15, 230; 441/3–5
See application file for complete search history.

(56) References Cited

U.S. PATENT DOCUMENTS

| | | | |
|---|---|---|---|
| 4,090,538 A | 5/1978 | Kotcharian | |
| 4,261,398 A | 4/1981 | Haley | |
| 4,388,948 A | 6/1983 | Carminati et al. | |
| 5,363,789 A | 11/1994 | Laurie et al. | |
| 6,923,225 B2 * | 8/2005 | Poldervaart et al. | 141/387 |

FOREIGN PATENT DOCUMENTS

| | | |
|---|---|---|
| FR | 2234221 | 1/1975 |
| WO | 93/24731 | 12/1993 |

* cited by examiner

*Primary Examiner*—Steven O. Douglas
(74) *Attorney, Agent, or Firm*—Young & Thompson

(57) ABSTRACT

A hydrocarbon transfer system includes a first structure carrying an articulated arm. The system has at a free end a first connector part, and a vessel comprising a second connector part, wherein each connector part comprises a housing with at least two fluid ducts within the housing. The ducts can be placed into sealing engagement along respective sealing faces, and a locking member for locking the housings of the connector parts together, wherein the fluid ducts in either the first or second connector are connected to a respective fluid swivel or flexible duct section to allow at least partial rotation of the ducts along their longitudinal axis, and are connected to a drive member for jointly rotating the ducts along a centreline of the connector parts.

16 Claims, 16 Drawing Sheets

CONNECTOR FOR ARTICULATED HYDROCARBON FLUID TRANSFER ARM

BACKGROUND OF THE INVENTION

The invention relates to a hydrocarbon transfer system, comprising a first structure carrying an articulated arm having at the free end a first connector part, and a vessel comprising a second connector part for releasably interconnecting hydrocarbon fluid ducts on the structure and on the vessel.

DESCRIPTION OF THE RELATED ART

U.S. Pat. No. 6,343,620 discloses a transfer device between a jib including at least one pipe section fixed to the jib and a coupling comprising a system of concertina or deformable diamond-shaped type articulated pipe segments. The brown structure is relatively complex and cannot transmit any mooring forces to couple a vessel, such as an oil tanker, in a constant relative position with repsect to a platform 10 carrying the crane.

From U.S. Pat. No. 5,363,789, in the name of the applicant, a connector system is known for connecting the risers on a submerged riser supporting buoy to the bottom of a turret of a weathervaning vessel. In the known mooring system, the mooring lines are attached to the riser supporting buoy, which is pulled via a cable running through the turret against the bottom of the turret. Upon coupling, the sealing faces of the risers can be withdrawn below the contact surface of the riser supporting buoy and the turret. Through hydraulic actuation, the moveable riser ends can be extended in the length direction of the risers after attaching the buoy to the turret to warrant a fluid tight coupling.

The known riser connecting system has as a disadvantage that the coupling system cannot be accessed easily for maintenance or repair purposes.

Furthermore, the known is system is not suitable, for loading or offloading via an articulated arm to shore or to another offshore construction such as a platform or tower-supported construction.

SUMMARY OF THE INVENTION

It is an object of the present invention to provide a loading and offloading system of relatively simple design, which can be used for mooring a vessel to a structure and for loading and offloading hydrocarbon fluids such as oil, gas, compressed gas or LNG via the articulated arm.

It is a further object of the present invention to provide a loading and offloading system through which multiple fluid ducts, for instance supplying different fluids at different temperatures or pressures, can be simultaneously connected and disconnected in a rapid an reliable manner.

It is a particular object of the present invention to provide a LNG hydrocarbon transfer and mooring system It is again another object of the present invention to provide a transfer system in which the connector parts are easily accessible for maintenance and/or repair.

Thereto, the hydrocarbon system according to the present invention, for each connector part comprises a housing with at least two fluid ducts within said housing, ducts can be placed into scaling engagement along respective sealing faces, and a locking member for locking the housings of the connectors together, wherein the fluid ducts in either the first or second connector:

are connected to a respective fluid swivel or flexible duct section to allow at least partial rotation of the ducts along their longitudinal axis, and are connected to a drive means for jointly rotating the ducts along a centre line of the connectors for alignment of the ducts in the first and second connectors, the fluid ducts in the first or second connector comprising a part which is displaceable in the longitudinal direction, by a displacement member for varying the axial position of the sealing faces of the movable duct sections relative to the housing.

Upon connecting of the firs and second housings of the connector parts on the articulated arm and on the vessel, the movable fluid transfer duct sections may be withdrawn in the length direction below the contact surfaces of their housing. After approach of the connector parts, the drive means may be actuated to properly align the fluid ducts in both connector parts. The product swivels or flexible duct parts allow, upon alignment, partial or full rotation of the connector parts and allow, after interconnecting, full or semi-weathervaning of the vessel with respect to the articulated arm.

The connector parts according to the present invention are suitable for simultaneously connecting a number of fluid transfer ducts, which may have different diameters and which may supply fluids at different temperatures and pressures, such as LNG ducts and vapour return ducts, crude oil and gas, compressed gas, chemicals, water, etc.

Furthermore, the articulated mooring arm is able to take up mooring forces of the vessel, such that a separate mooring system of additional hawsers, or mooring chains is not required for stable positioning of the vessel relative to the structure, such as platform, tower, onshore loading and offloading terms production and storage vessels, and the like.

In one embodiment of the transfer system according to the present invention, the fluid swivel or flexible duct section and the drive means are placed in the housing of the second connector on the vessel. In this way, easy access to the critical and moveable parts of the connector part and to swivels is achieved from the vessel.

Furthermore, the weight of the arm can be reduced allowing easier handling and quick disconnection in emergencies. Preferably, the displacement members of the fluid transfer ducts, for instance an assembly of a bellow, hydraulic cylinder and spring, are placed in the housing of the second connector, i.e. on the vessel for easy access and maintenance.

The arm structure carrying the transfer ducts whereas leakage free interconnection of the housing and/of the ducts along their sealing faces and forms a transfer system which is able to take-up mooring forces while at the same time safely and reliably transferring hydrocarbon fluids.

In one embodiment, a pulling member is able to a central part of the first and second connectors and extends through a central space of the housing of at least one of the connectors, the pulling member being connected to a take up device on the arm or on the vessel.

A first alignment of the connector parts is obtained by hauling in the pulling member, which may be a cable, wire rope or chain. The pulling member may be attached to a winch, which can be placed on the articulated arm. The pulling member extends through the central part of the first and second connectors.

For fine positioning of the connector part on the vessel and the free end of the, arm, the housing of the connector parts comprises on each side of a centre line a flange, the second connector part comprising at least two retractable grippers for engaging with a respective flange and for placing the housings of the first and second connector with contact faces in mutual engagement.

The grippers operating on the housing of the connector part on the arm allow for accurate alignment and positioning of the connector part and engaging the contact faces of each connector part. The housing of the first connector part may comprise a circumferential rim whereas the second connector part comprises clamping means for engaging with the rim. The interconnection of the housing will transfer the mooring forces to a large extent whereas separate interconnection of fluid transfer ducts via the drive means for rotational alignment and the displacement of the ducts in the length directions, allows a fluid tight connection which is not subject to substantial forces. The second connector part on the vessel may comprise at the radial distance thereof, a ring-shaped guiding member sloping downwards in the direction of the centre line of the connector. The ring-type fender construction prevents the connector part on the arm from impacting with the vessel and from consequent damage. The connector at the free end of the arm is guided along the ring-shaped guiding member to its approximate coupling position.

BRIEF DESCRIPTION OF THE DRAWINGS

A number of embodiments of a transfer system according to the present invention will be described in detail with reference to the accompanying drawings. In the drawings.

DESCRIPTION OF THE PREFERRED EMBODIMENTS

Figure 1:
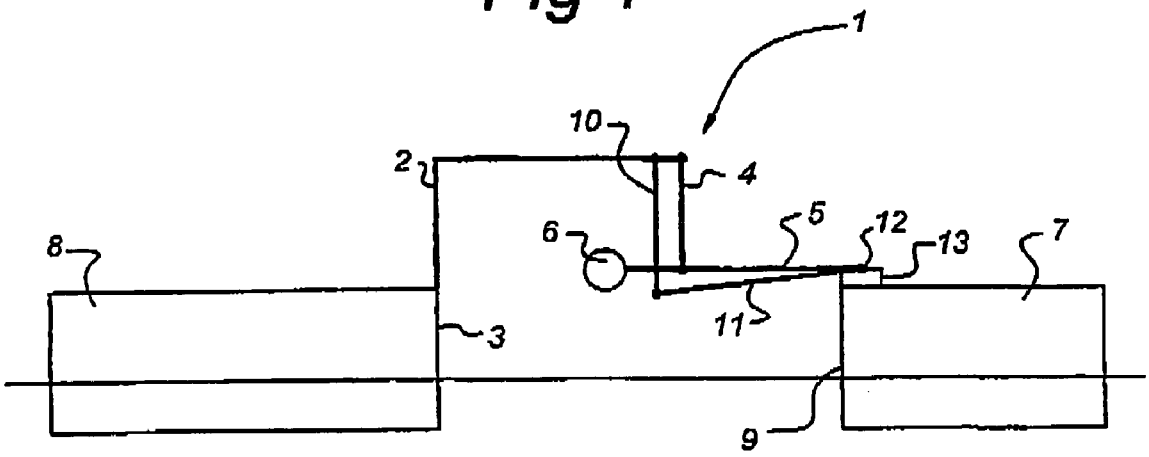
FIG. 1 shows a schematic side view of the cryogenic transfer system for tandem offloading according to the present invention.

FIG. 1 schematically shows the hydrocarbon transfer system 1 of the present invention comprising a support structure 2 placed at the stern 3 of a FPSO barge. From the support structure 2, a first vertical arm 4 is suspended and is connected to a substantially horizontal second arm 5. At a restoring end, a counterweight 6 is connected to the arm 5, which at a coupling end is provided with a mechanical connector 13 for attaching to the bow 9 the LNG-carrier 7. Parallel to the mooring arms 4, 5 cryogenic fluid transfer lines 10, 11 are placed, which are suspended on one side from the support structure 2 and which on the other side are connected in an articulation joint 12 to the mechanical connector 13 of the mooring arm 5. By connecting the flow lines to the mechanical connector, a rapid connection is possible and also a rapid release during emergency situations. However, the transfer line 11 may at its end be connected to the arm 5 instead of to the mechanical connector. The end of transfer line 11 is provided with a fluid connector for connecting to the pipe system of the LNG-carrier 7 after mechanical connection. The dimensions indicated in FIG. 1 are indicative for the order of magnitude of the mooring and transfer system of the present invention by way of illustrative example.

Figure 2:
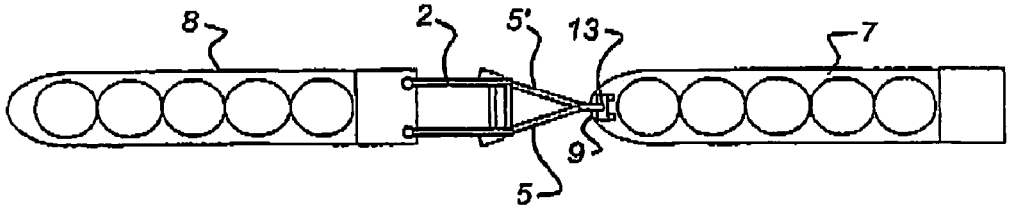
FIG. 2 shows a top view of the transfer system of FIG. 1.
Figure 3:
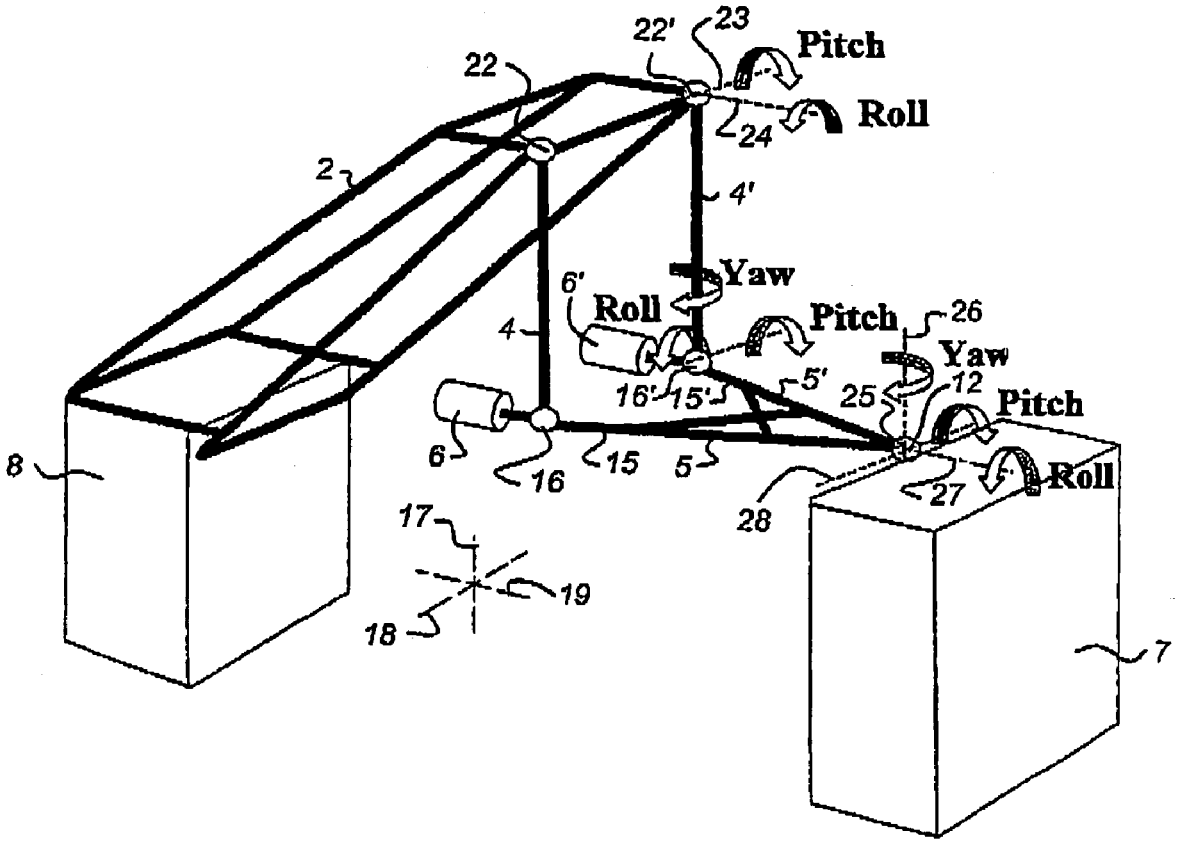
FIG. 3 shows a schematic perspective view of the mooring construction of the present invention.

FIG. 2 shows a top view of the FPSO 8 and LNG-carrier 7, the support structure 2, the horizontal mooring arms 5, 5' and the mechanical connector 13, As can be seen from FIG. 3, the horizontal mooring arms 5, 5' are with their restoring end parts 15, 15' connected to a respective vertical arm 4, 4' via articulation joints 16, 16'. Two counterweights 6, 6' are connected to the restoring end parts 15, 15' of each arm 5, 5'. The articulation joints 16, 16' may for instance comprise three perpendicular circular bearings, or ball-joints allowing rotation around a vertical axis 17 (Yaw), a transverse axis 18 (pitch) and a longitudinal axis 19 (roll).

The vertical mooring arms 4, 4' are at their upper ends connected to the support structure 2 in articulation joints 22, 22' allowing rotation of the arms 4, 4' around a transverse axis 23 and a longitudinal axis 24. At the coupling end part 25, the arms 5, 5' are provided with the mechanical connector 13 allowing rotation around a vertical axis 26 (yaw), a longitudinal axis 27 (roll) and a transverse axis 28 (pitch). The mechanical connector is not shown in detail but may be formed by a construction such as described in U.S. Pat. No. 4,876,978 in the name of the applicant, which is incorporated herein by reference.

Figure 4:
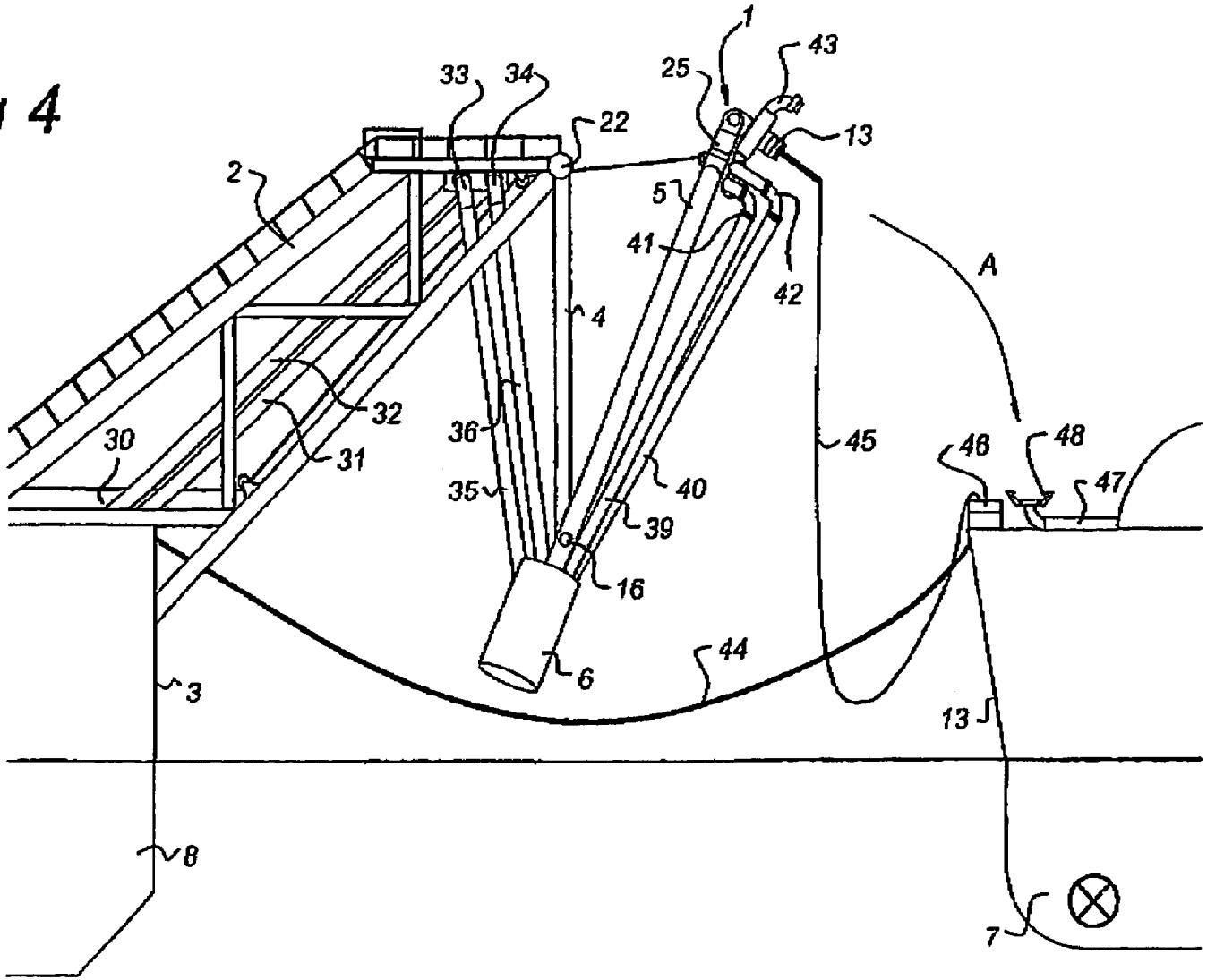
FIG. 4 shows a side view of the mooring arms and transfer pipes prior to coupling of the mechanical and fluid connectors.

FIG. 4 shows the transfer system 1 in which the mooring arms 5 are placed in a substantially vertical position via a cable 30 attached to the coupling end part 25 of the arms 5, 5' and connected with its other end to a winch (not shown) on the FPSO 8. Two rigid pipes 31, 32 extend from the FPSO 8 to a swivel connection 33, 34 on the support structure 2. From the swivel connections 33, 34 two vertical pipes 35, 36 extend downwardly to swivel connections 37, 38 (see FIG. 5). Two horizontal cryogenic transfer pipes 39, 40 extend along the arms 5, 5' to swivel connections 41, 42 on the mechanical connector 13. A fluid connector 43 is provided on the mechanical connector 13.

During connecting of the mooring arms 5, 5' to the bow 9 of the LNG-carrier 7, the vessels are connected via a hawser 44. Via a pilot line 45, the mechanical connector 13 can be lowered and placed into a receiving element 46 on deck of the LNG-carrier 7. By paying out cable 30, the horizontal arm 5 pivots in articulation joints 16, 16' around the transverse axis 18. The vertical ducts 35, 36 can pivot around a transverse axis 23 in articulation joints 33, 34 and in articulation joints 37, 38 as shown in FIG. 5 to assume a substantially vertical position.

Figure 5:
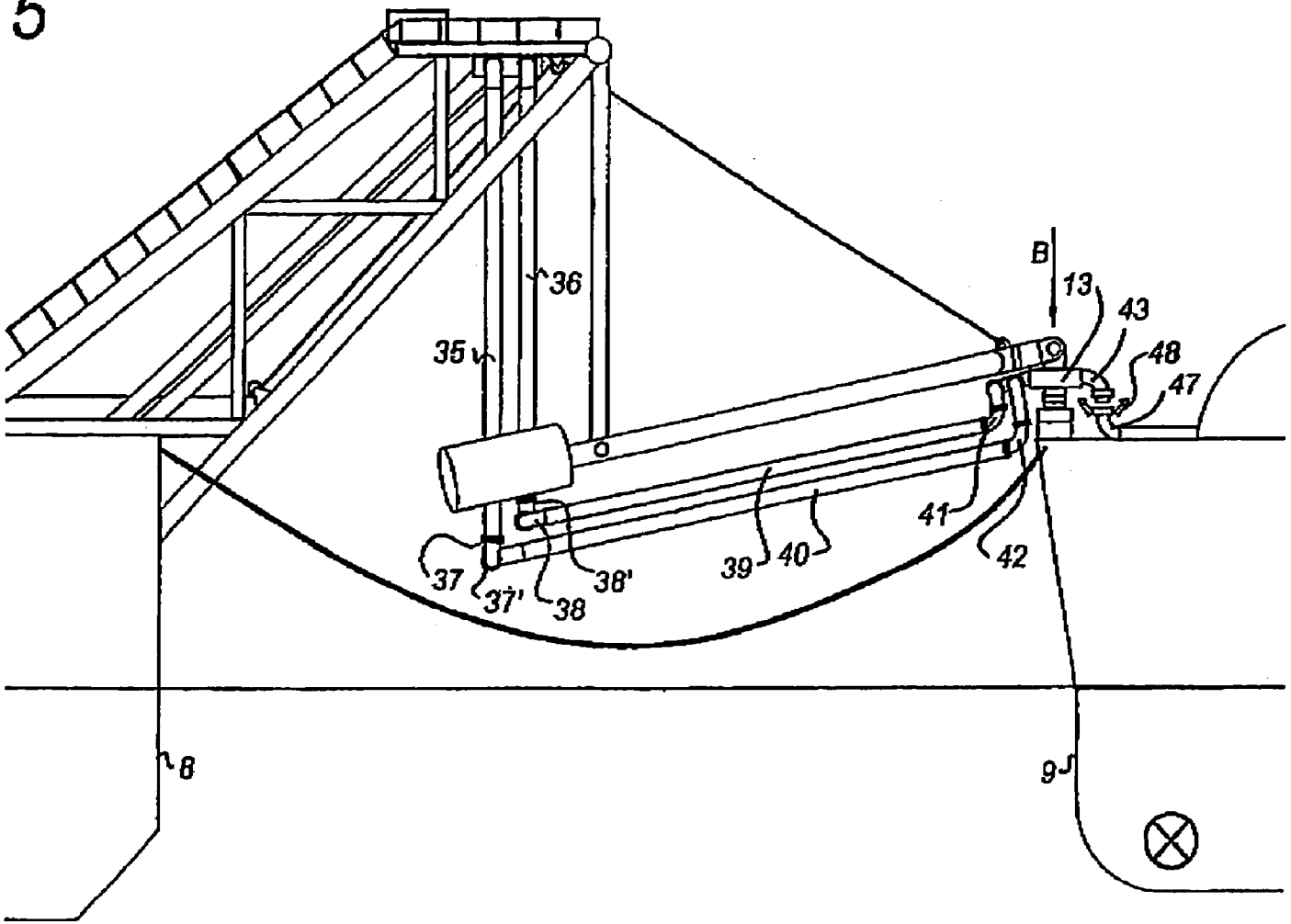
FIG. 5 shows the transfer system of FIG. 4 wherein the mooring arms are attached via the mechanical connector.
Figure 6:
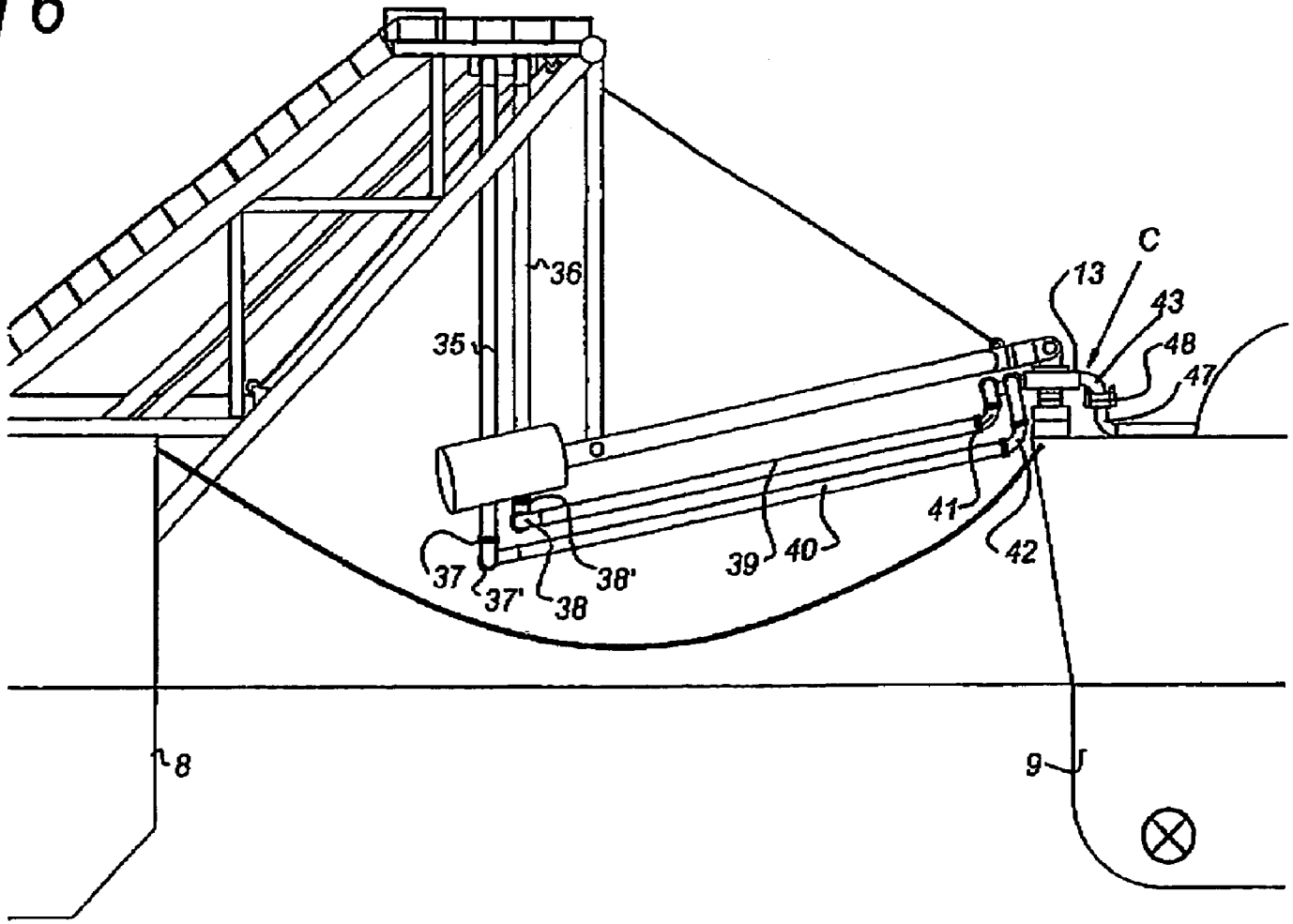
FIG. 6 shows attachment of the fluid connector of the transfer lines.

The horizontal ducts 39, 40 will also pivot around a vertical axis at swivels 37', 38' and a transverse axis a horizontal axis and a vertical arm at the position of two sets of each three perpendicular swivels 41, 42 until the mechanical connector 13 mates with receiving element 46 as shown in FIG. 5. After locking the mechanical connector 13, the fluid connector 43 is attached to piping 47 on deck of the LNG-carrier 7 by raising said piping and engage clamps 48 such as shown in FIG. 6.

Figure 7:
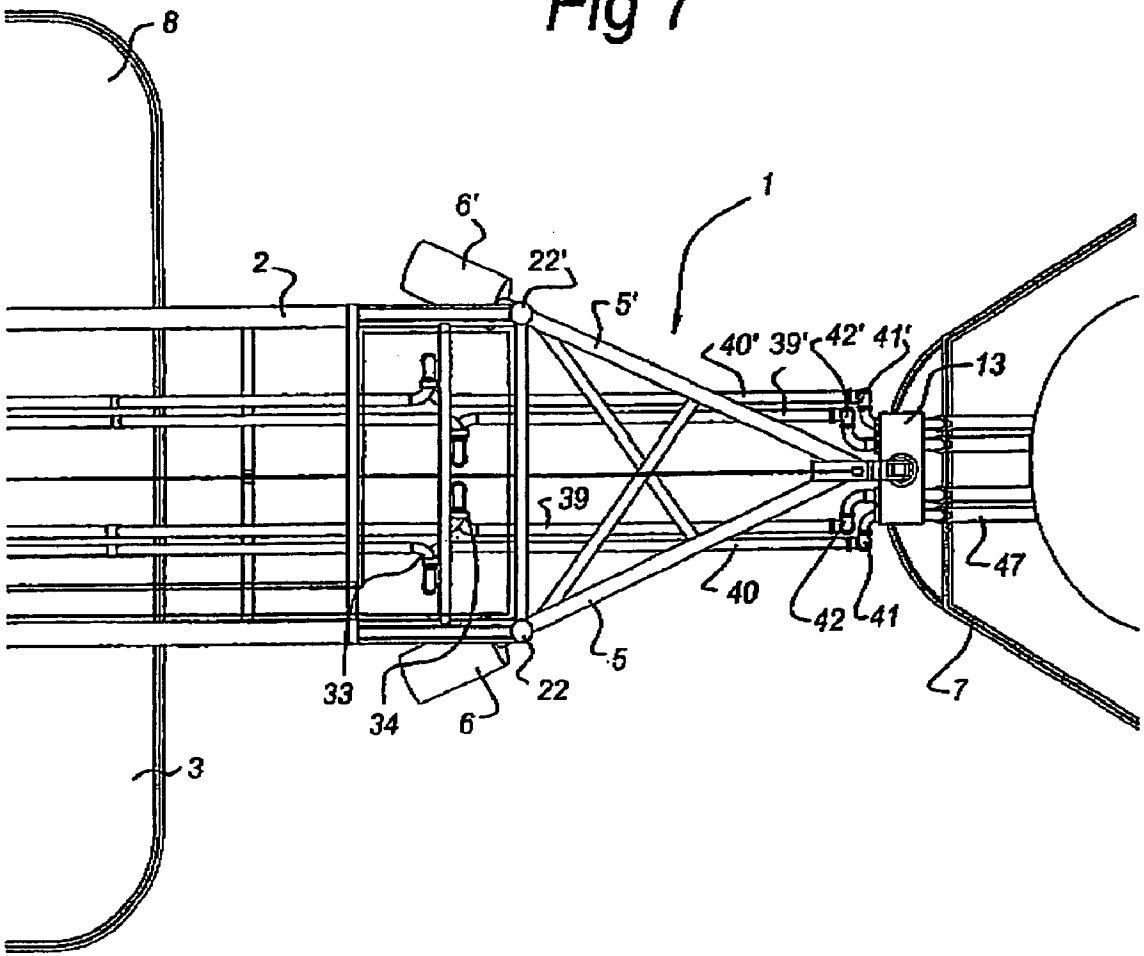
FIG. 7 shows a top view of the transfer system of FIGS. 4–6.

FIG. 7 shows a top view of the transfer system 1 in the connected state showing four pipes 39, 39', 40, 40' attached to the mechanical connector 13. The transfer pipes 35, 36 are connected to the support structure 2 in articulation joints 33, 34 and can pivot around a substantially longitudinal axis. The pipes 39, 39', 40, 40' are connected to the mechanical connector 13 in articulation joints 41, 41', 42, 42' and can pivot around a longitudinal, a transverse and a vertical axis. The pipes can move independently of the mooring arms 4, 4', 5, 5'. During yaw-movements of the FPSO 8 or LNG-carrier 7, a good control and sufficient yaw-stiffness is achieved by the arms 5, 5' connected to the counterweights 6, 6'. Yaw displacement (in the horizontal plane) of the LNG-carrier will be counteracted by a restoring moment created by the counterweights 6, 6'. By separating the mooring function and the fluid transfer function, a simplified and proven cryogenic transfer system can be achieved using state of the art components and resulting in reduced and simplified maintenance.

Figure 8:
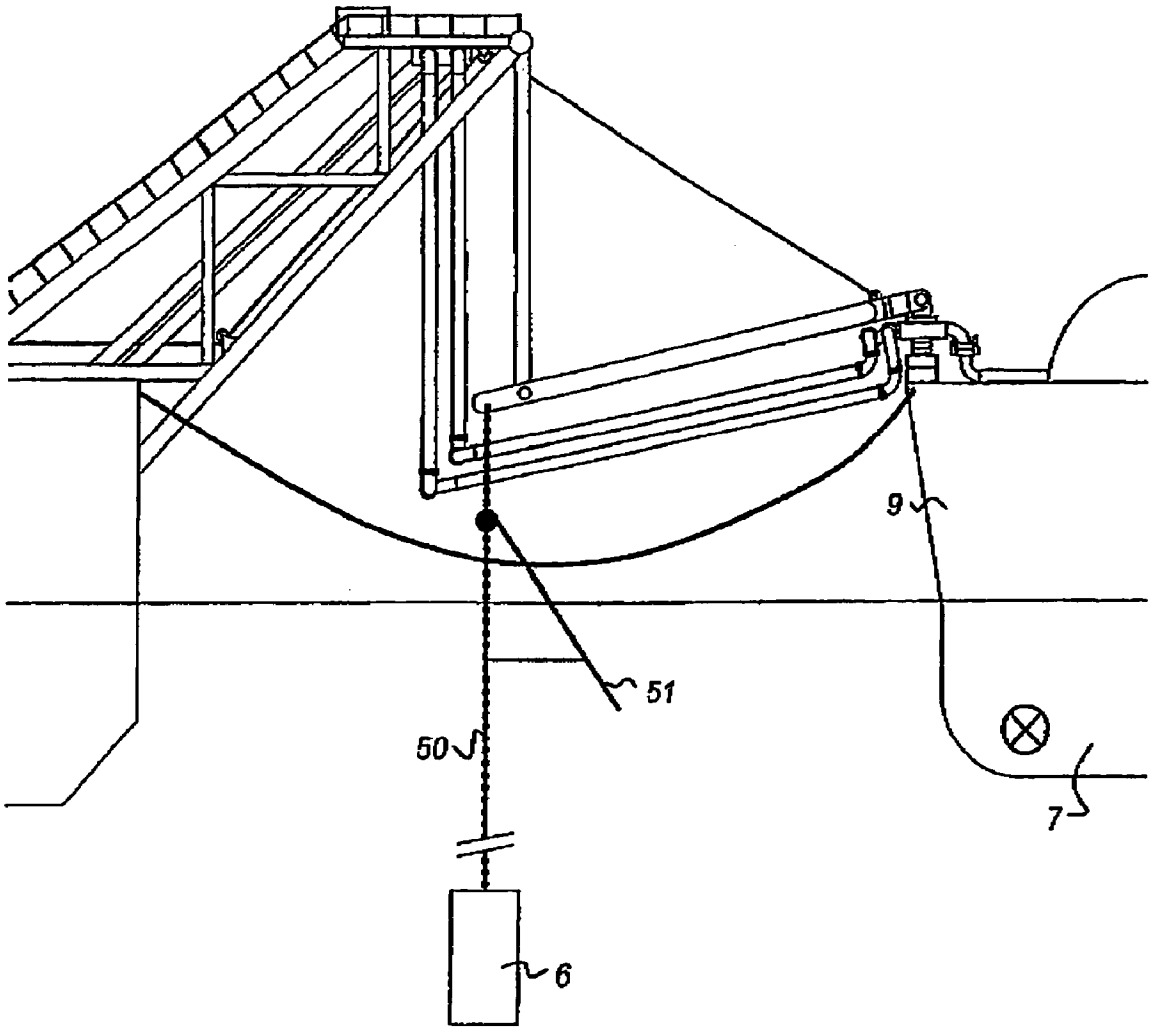
FIG. 8 shows an alternative embodiment of the counterweight of the mooring arms.

As shown in FIG. 8, the counterweights 6 may be suspended from a cable 50 such that movements of the counterweights 6 are damped below water level. A fender 51 may be applied on cable 50 for the counteracting movement of the vessel 7 towards vessel 8 upon lifting of the mooring system 1 to the configuration as shown in FIG. 4. When the bow 9 of the vessel 7 contacts the fender 51, the tension in the chain 50 will exert a restoring force on the vessel.

The fender system described above could be a fender system as described in U.S. Pat. No. 4,817,552 in the name of the applicant. The counterweights 6, 6' can be formed by clumpweights, flushable tanks, buoyancy elements and other constructions generally employed in soft yoke mooring systems. Even though the invention has been described in relation to hard piping 35, 35', 36, 36', 39, 39' and 40, 40' in combination with pipe swivels at articulation joints 33, 34, 41, 42, also flexible hoses or combinations of flexible hoses and hard piping, and ball-joints instead of pipe swivels can be employed. An example of a ball-joint suitable for cryogenic fluid transfer has been described in WO00/39496, which is incorporated herein by reference.

Figure 9:
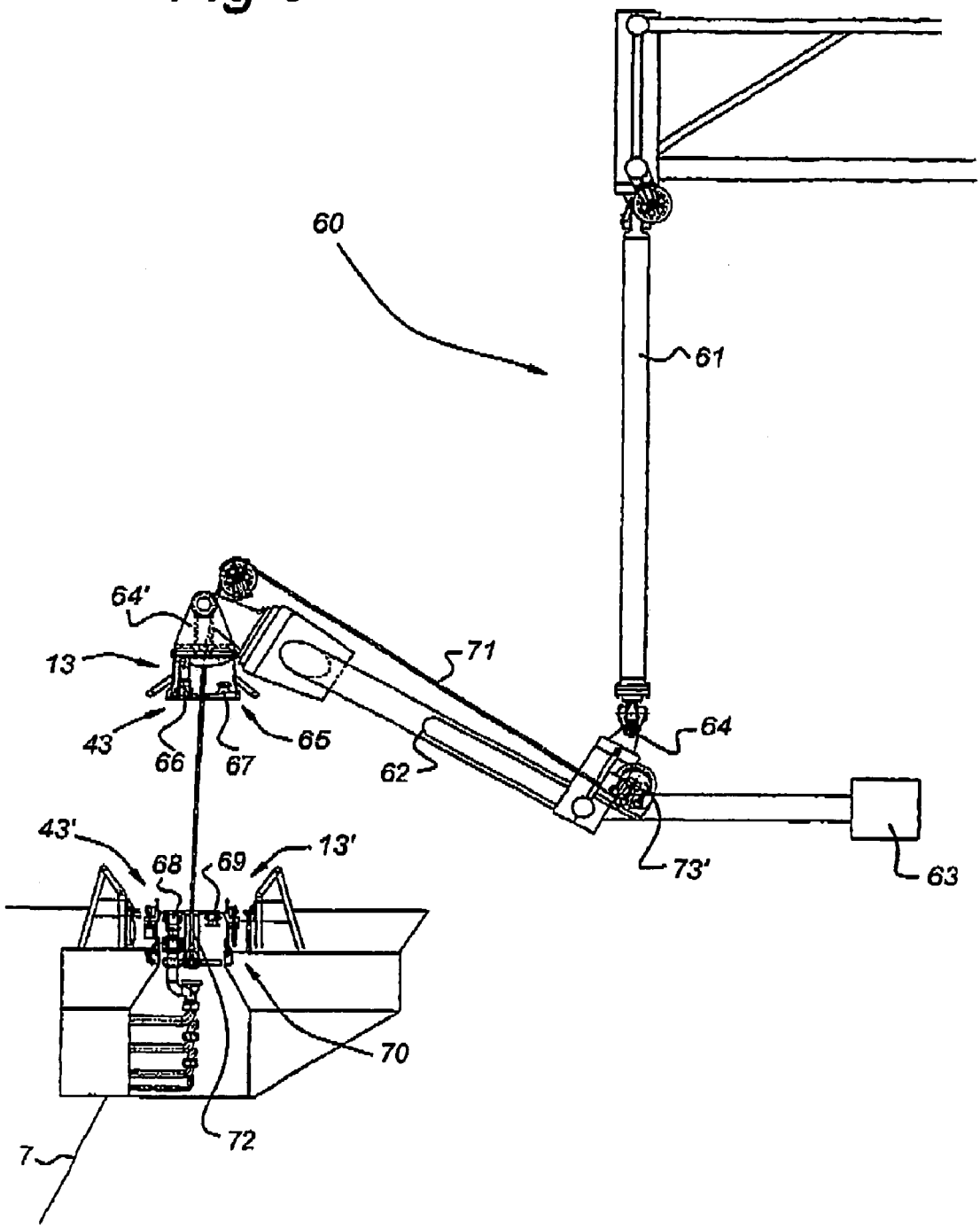
FIG. 9 shows a detail of the connector parts of a transfer system according to the present invention in the disconnected stage.

FIG. 9 shows the connectors of a hydrocarbon transfer system 60 according to the present invention, with an articulated arm 61, 62 suspended from a structure. The structure can be a platform, a semi submersible structure, an offshore tower or arm or an onshore loading/off loading terminal. The arm 62 is supported in a substantially horizontal position in a hinge point 64 from vertical arm 61 and is balanced by a counterweight 63. At the free end 64', the arm 62 carries a first connector part 65 of mechanical connector 13, 13'. Within the arms 61, 62, or supported externally on the arms 61, 62, such as shown in FIGS. 4–8, hydrocarbon fluid ducts 66, 67, for instance LNG ducts and vapour return ducts, are situated. The ducts 66, 67 can be attached to fluid transfer ducts 68, 69 in second connector part 70 of fluid connector 43, 43'. The first connector part 65 can be lowered onto the second connector part 70 on the vessel 7 via a cable 71 which extends through a central space 72' of connector part 70 and through the connector part 65 at the end of arm 62, to a winch 73' on the arm 62.

Figure 10:
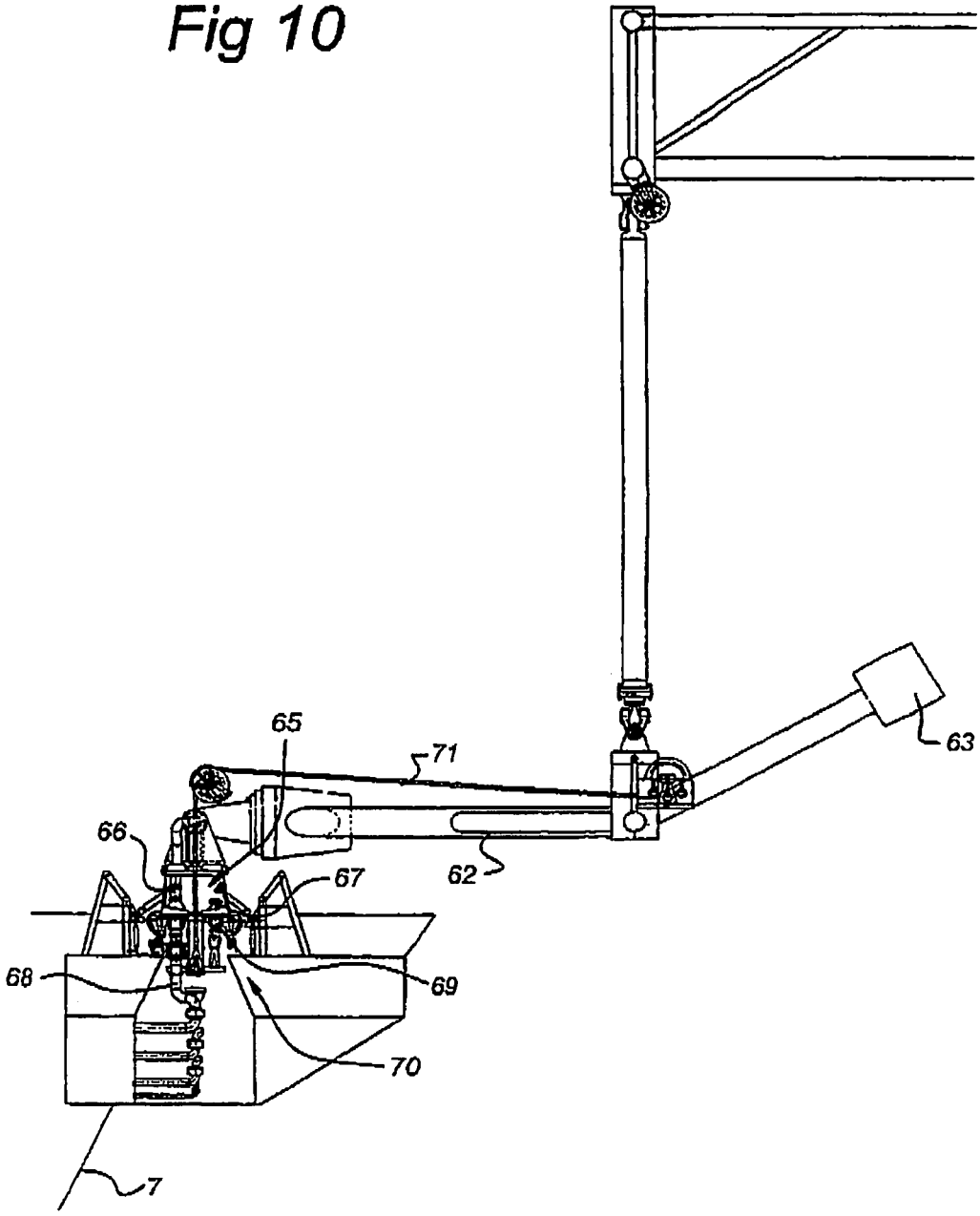
FIG. 10 shows the connector parts of FIG. 9 in the connected situation.
Figure 11:
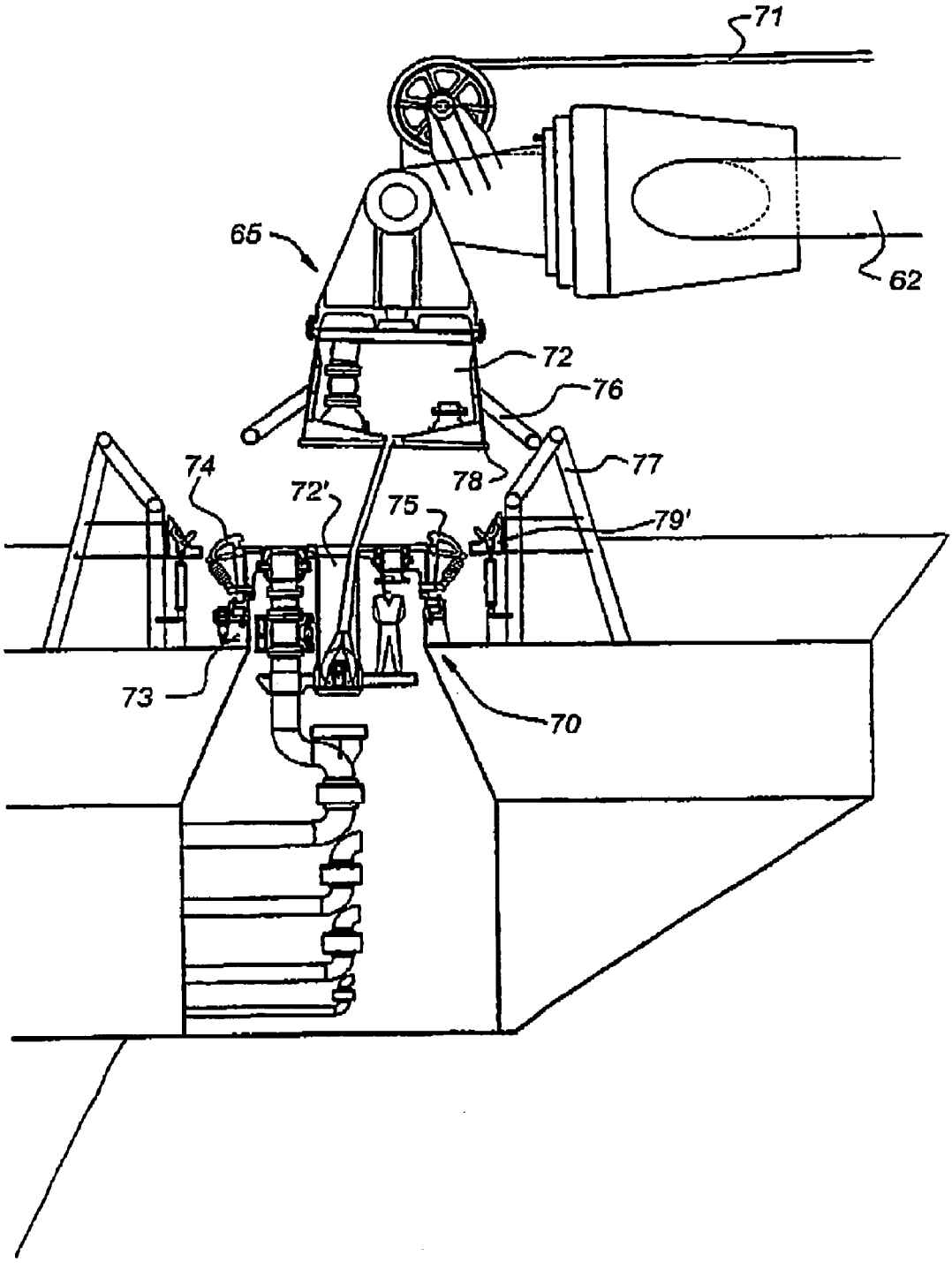
FIG. 11 shows a detail of the connector parts of FIG. 9, the connector parts at the end of the arm approaching the connector parts on the vessel.

As can be seen from FIG. 10, by tightening the cable 71, the first connector part 65 and second connector part 70 can be engaged and locked in position, and fluid connection between fluid transfer ducts 66, 68, 67, 69 is established, In FIG. 11 it is shown how the housing 72 of first connector part 65 is provided with a sideways flange or finder 76 for positioning of the first connector part 65 with respect to a fender 77 placed around and above second connector part 70. By lowering the arm 62, the connector part 65 is guided by the downwardly sloping part of the fender 77 to the second connector part 70 by tightening of the cable 71, to an approximate coupling projection.

Figure 12:
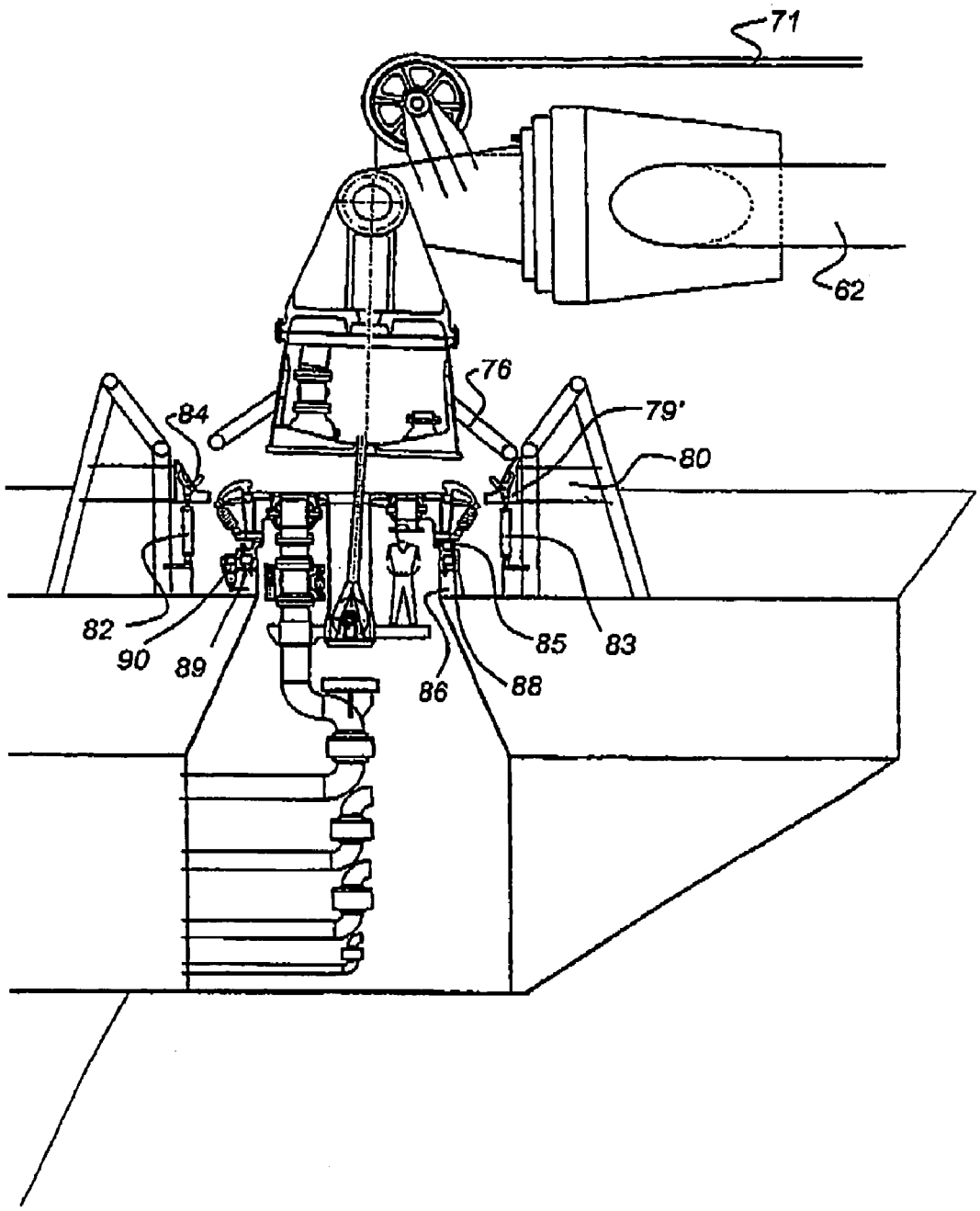
FIG. 12 shows the connector parts prior to engagement of retractable grippers.
Figure 13:
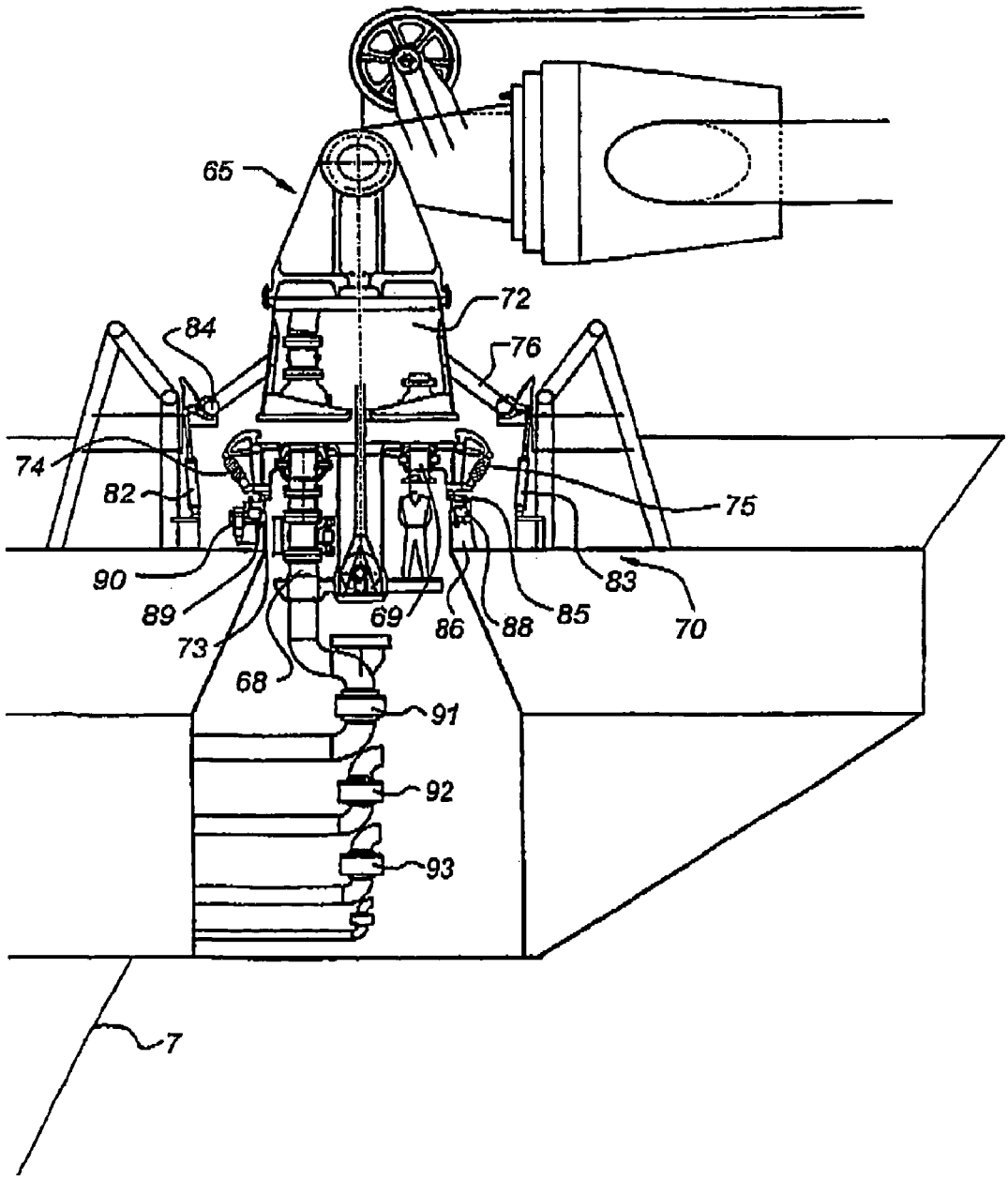
FIG. 13 shows the connector parts being aligned by the retractable grippers.

As is shown in FIG. 12, the fender 76 is contacted by a guiding surface 79, which is mounted on a frame 80. By sliding down the guiding surface 79', the fender 76 can be engaged with hydraulic grippers 82, 83, as shown in FIG. 13. The grippers 82, 83 comprise a hydraulic cylinder and rotatable clamping head 84 that, when placed in the position shown in FIG. 13, clampingly engages with fender 76.

Figure 14:
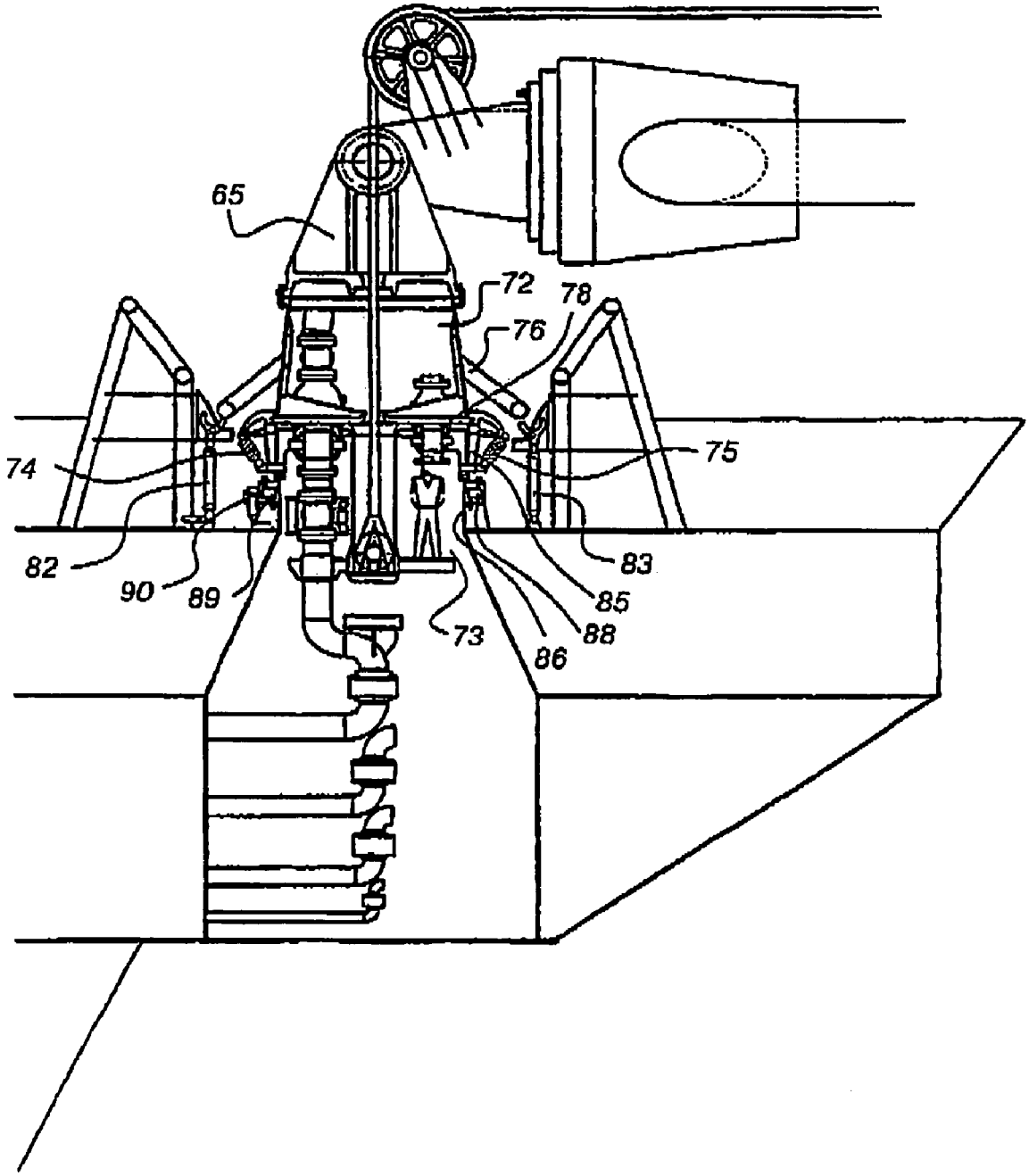
FIG. 14 shows the connector parts, aligned one above the other and interconnected through clamping meams.

As shown in FIG. 14, the housing 72 of first connector part 65 and housing 73 of second connector part 70 are placed one on top of the other, in an aligned position, whereafter the grippers 82, 83 are released and the locking member 74, 75 are engaged with circumferential rim 78 on housing 72. Prior to or after attaching the locking member 74, 75, in the situation shown in FIG. 13, the upper part 85 of housing 73 of second connector part 70 can be rotated around a centreline relative to a support part 86 via bearings 88, 89. Rotation is imparted by a drive motor 90, which may state the upper part 85 through a small angle or through 360° when required. Rotational sections of the ducts interconnected via first and second connector parts 65, 70 are placed within the vessel 7 below second connector part 70 as shown in FIGS. 11, 12 and 13 for swivels 91, 92 and 93.

Figure 15:
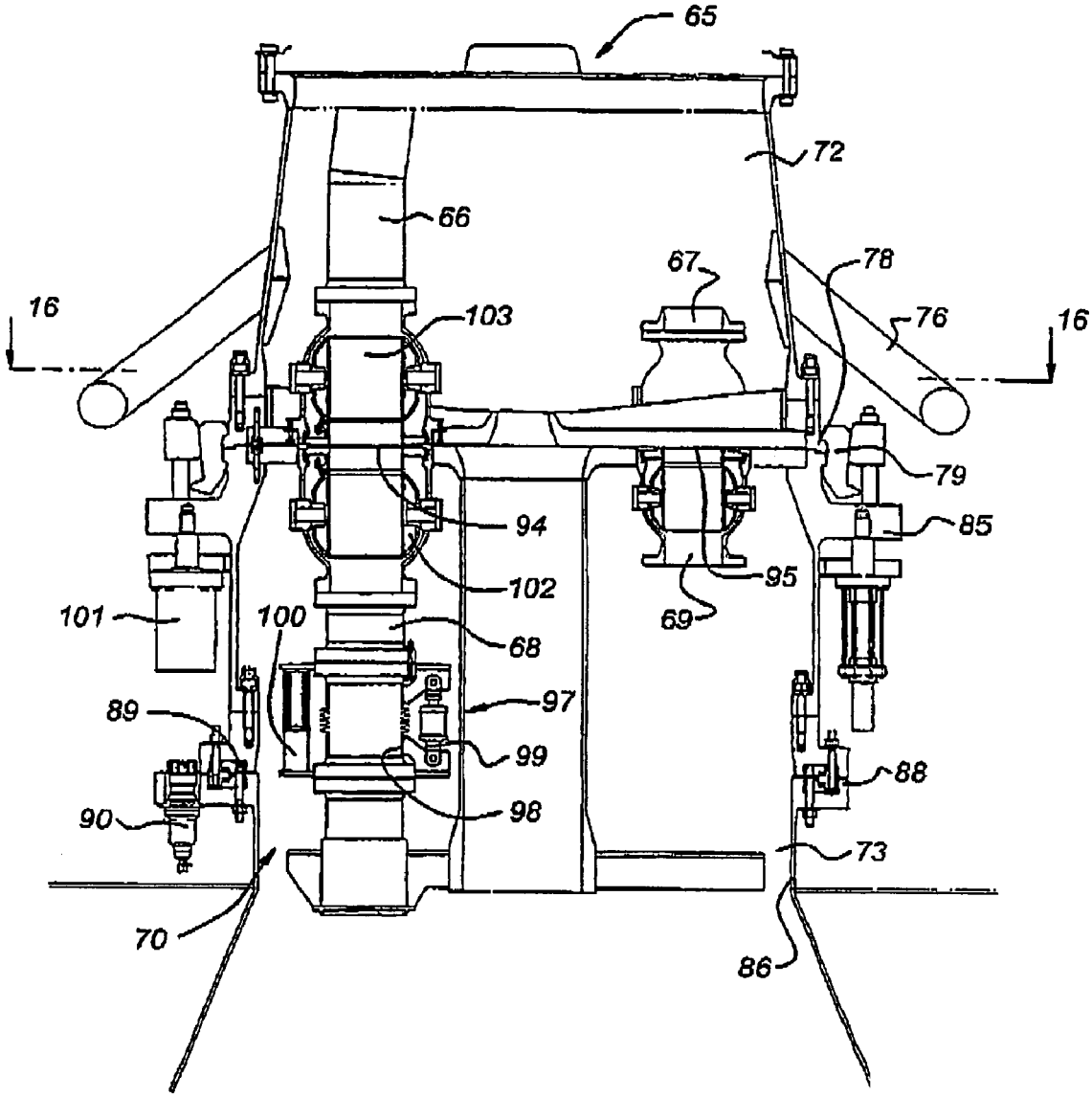
FIG. 15 shows a detail of the interconnected connector parts and fluid ducts.

As can be seen in FIG. 15, the housing 72 of upper connector part 65 is attached to housing 73 of second connector part 70 through a collet ring 79 locking on the circumferential rim 78 on housings 72, 73. After mechanical interconnection of housings 72, 73, or simultaneous therewith, the sealing faces 94, 95 of fluid ducts 66–69 are engaged. The ducts 68, 69 in the lower connector part 70 each comprise displacement members 97 in the form of a deformable bellow wall part 98, a hydraulic jack 99 and a spring 100. During the connection phase, the bellows 98 arm retracted by the hydraulic jack 99 attached adjacent to the bellow by a few mm to a few cm below the plane of interconnection of housings 72, 73. Retraction of the hydraulic jack 99 compresses spring 100 such that the sealing face 94 is retracted below the contacting surface of lower connector part 73. After connection of the collet ring 79, by actuation of hydraulic jacks 101, the jack 97 is depressurised such that spring 100 will push the upper part of fluid duct 68 upwards against the sealing face 94, 95 of upper fluid ducts 66, 67. After connection of fluid ducts 66, 68, both fluid duct sections 66, 68 will be able to rotate together upon rotation of rotating part 85 of lower connector part 73 on bearings 88, 89 and upon rotation of the upper duct section of duct 68 relative to stationary piping on the vessel 7 via swivel 91.

Each duct 66, 68 comprises ball valves 102, 103 which are closed prior to connecting duct sections 66, 68 and which are opened after fluid tight connection of the sealing faces 94, 95. The ball valves 102, 103 are situated near the end sections of the ducts, such that small gas volumes are present above the valves, such that safe disconnecting can take place without a risk of large volumes of gas being set free.

Figure 16:
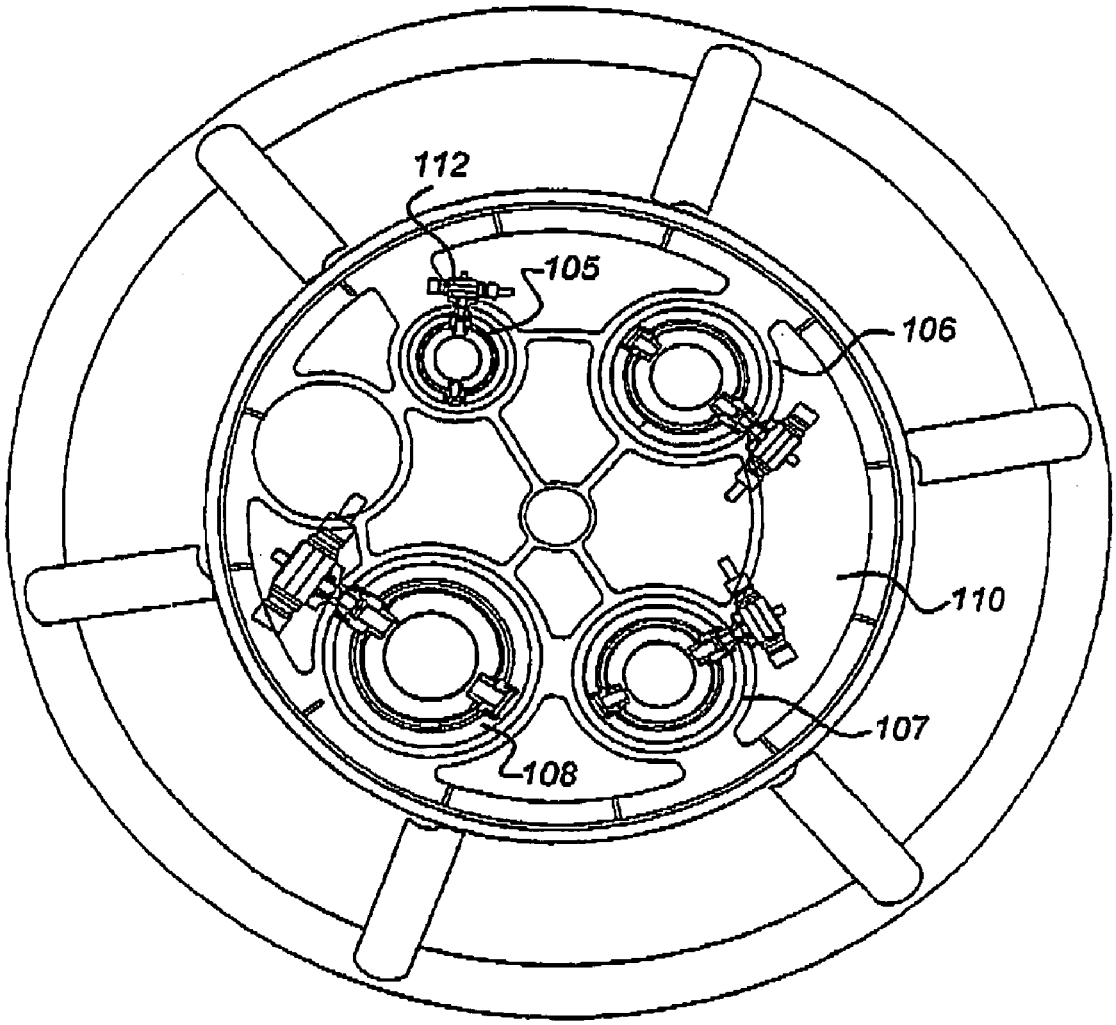
FIG. 16 shows a cross-section along the line 16—16 in FIG. 15.

As shown in FIG. 16, four ducts 105, 106, 107, 108, such as product fluid line (LNG), a vapour return duct, a warning gas duct, displacement gas duct, and a back up duct, are comprised in a support fame 110. Ball valves 105–108 are each opened and closed by a respective valve actuating unit 112.

Figure 17:
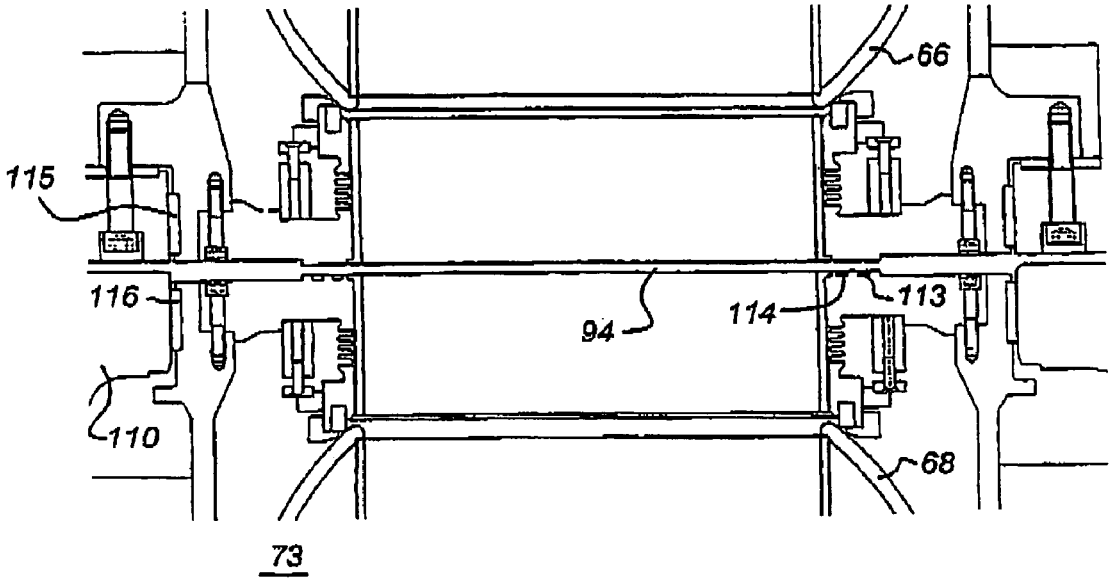
FIG. 17 shows an enlarged detail of the connected interfaces of the fluid ducts in the first and second connectors.

Finally, FIG. 17 shows the sealing face 94 of upper duct 66 and lower duct 68 comprising angular seals 113, 114 and a slide bearing 115, 116. The slide bearings 115, 116 have a dual function as they isolate the fluid path of ducts 66, 68 from the other parts of the connector and they function as slide bearings for allowing relative movement of the lower duct 68 with respect to supporting frame 110. The rings 115, 116 can for instance be made of PTFE.

The invention claimed is:

1. Hydrocarbon transfer system comprising a first structure (8) with a first connector part (13, 43, 65), and a vessel (7) comprising a second connector part (47, 48, 70), wherein each connector part comprises a housing (72, 73) with at least two fluid ducts (66, 67, 68, 69) supported by said housing, which ducts can be placed into sealing engagement along respective sealing faces (94,95), and a locking member (74, 75, 78, 79, 101) for locking the housings (72, 73) of the connector parts together when the housings are in a locking position in which contact faces of the housings (72, 73) are in mutual engagement, wherein the fluid ducts (68,69) of either the first or second connector part:

are connected to a respective fluid swivel (91, 92, 93) to allow at least partial rotation of the ducts along their longitudinal axis, and are connected to a drive means (90) for jointly rotating the ducts along a centerline of the connector parts for alignment of the ducts in the first and second connector parts, the fluid ducts of the first or second connector part comprising a section (98) which is displaceable in the longitudinal direction, by a displacement member (97) for varying the axial position of the sealing faces (94, 95) of the movable duct sections relative to the housing, characterised in that, the first structure carries an articulated arm (4, 5, 61, 62), having at a free end (64') the first connector part (13, 43, 65), wherein the housing (72) of the first connector part (65) comprises on each side of a centerline first attachment means (76), the second connector part (70) comprising complementary attachment means (82, 83) for engaging with the first attachment means (76) when the housings are in an alignment position in which the housings (72, 72) are in a relatively spaced-apart relationship and for placing the housing (72, 73) in the locking position.

2. Hydrocarbon transfer system according to claim 1, wherein the second attachment means comprise at least two retractable grippers (82, 83).

3. Hydrocarbon transfer system according to claim 1, wherein the housing of the first connector part (65) comprises a circumferential rim (78), the second connector part (70) comprising clamping means (74, 75, 78, 79, 101) for engaging with the rim.

4. Hydrocarbon transfer system according to claim 1, wherein the fluid swivel (91, 92, 93) and the drive means (97) are placed in the housing of the second connector part (70).

5. Hydrocarbon transfer system according to claim 4, wherein the displacement members (97) are placed in the housing (73) of the second connector part (70).

6. Hydrocarbon transfer system according to claim 1, wherein a pulling member (71) is attachable to a central part of the first and second connector parts (65, 70) and extends through a central space (72') of the housing of at least one of the connectors parts, the pulling member being connected to a take up device (73) on the arm (61, 62) or on the vessel (7).

7. Hydrocarbon transfer system according to claim 1, the second connector part (70) comprising at a radial distance thereof, a ring-shaped guiding member (77) sloping downwards in the direction of the centerline of the second connector part(70).

8. Hydrocarbon transfer system according to claim 1, wherein the displaceable sections of the fluid ducts comprise a bellow (98).

9. Hydrocarbon transfer system according to claim 1, wherein the housing (73) of the second connector part (70) comprises an annular support (86) and an annular rotating part (85) connected to the support (86) via a bearing structure (88, 89) to be rotatable around a centerline of the housing (73).

10. Hydrocarbon transfer system according to claim 1, wherein the fluid ducts (68, 69) of at least one connector part extend with an upper part through a support frame (86) on the second connector part (70), and comprise an annular seal (113, 114) at their contact face, and a slide bearing (115, 116) at the position of the support frame (110) for allowing vertical movement of the fluid ducts along the support frame to be withdrawn below an upper part of the housing (73).

11. Hydrocarbon transfer system according to claim 1, wherein the fluid ducts (66, 67, 68, 69) in the first and second housing (72, 73) each comprise a closing valve (102, 103) at or near their end section.

12. Hydrocarbon transfer system according to claim 2, wherein the fluid ducts (66, 67, 68, 69) in the first and second housing (72, 73) each comprise a closing valve (102, 103) at or near their end section.

13. Hydrocarbon transfer system comprising a first structure (8) with a first connector part (13, 43, 65), and a vessel (7) comprising a second connector part (47, 48, 70), wherein each connector part comprises a housing (72, 73) with at least two fluid ducts (66, 67, 68, 69) supported by said housing, which ducts can be placed into sealing engagement along respective sealing faces (94,95), and a locking member (74, 75, 78, 79, 101) for locking the housings (72, 73) of the connector parts together when the housings are in a locking position in which contact faces of the housings (72, 73) are in mutual engagement, wherein the fluid ducts (68,69) of either the first or second connector part:

are connected to a fluid element (91, 92, 93) to allow at least partial rotation of the ducts along their longitudinal axis, and are connected to a drive means (90) for jointly rotating the ducts along a centerline of the connector parts for alignment of the ducts in the first and second connector parts, the fluid ducts of the first or second connector part comprising a section (98) which is displaceable in the longitudinal direction, by a displacement member (97) for varying the axial position of the sealing faces (94, 95) of the movable duct sections relative to the housing, characterised in that, the first structure carries an articulated arm (4, 5, 61, 62), having at a free end (64') the first connector part (13, 43, 65), wherein the housing (72) of the first connector part (65) comprises on each side of a centerline first attachment means (76), the second connector part (70) comprising complementary attachment means (82, 83) for engaging with the first attachment means (76) when the housings are in an alignment position in which the housings (72, 72) are in a relatively spaced-apart relationship and for placing the housing (72, 73) in the locking position.

14. Hydrocarbon transfer system according to claim 13, wherein the second attachment means comprise at least two retractable grippers (82, 83).

15. Hydrocarbon transfer system according to claim 13, wherein the housing of the first connector part (65) comprises a circumferential rim (78), the second connector part (70) comprising clamping means (74, 75, 78, 79, 101) for engaging with the rim.

16. Hydrocarbon transfer system according to claim 13, wherein the fluid element (91, 92, 93) and the drive means (97) are placed in the housing of the second connector part (70).

* * * * *